US010661139B1

(12) United States Patent
Nicely

(10) Patent No.: US 10,661,139 B1
(45) Date of Patent: May 26, 2020

(54) BASKETBALL SHOOTING AIDE

(71) Applicant: V-Flex Technologies, Inc., Kingsport, TN (US)

(72) Inventor: Timothy J. Nicely, Bean Station, TN (US)

(73) Assignee: V-Flex Technologies, Inc., Kingsport, TN (US)

( * ) Notice: Subject to any disclaimer, the term of this patent is extended or adjusted under 35 U.S.C. 154(b) by 0 days.

(21) Appl. No.: 16/361,767

(22) Filed: Mar. 22, 2019

(51) Int. Cl.
*A63B 69/00* (2006.01)
*A63B 63/08* (2006.01)
*A63B 63/00* (2006.01)

(52) U.S. Cl.
CPC ..... *A63B 69/0071* (2013.01); *A63B 63/00* (2013.01); *A63B 63/08* (2013.01); *A63B 2225/093* (2013.01); *A63B 2243/0037* (2013.01)

(58) Field of Classification Search
CPC ..... A63B 69/0071; A63B 2225/093; A63B 2243/0037; A63B 69/0002; A63B 63/00; A63B 63/008; A63B 53/04; A63B 63/083
USPC ..... 473/422, 447, 448, 433, 434, 438, 476; 273/317.3, 348, 386, 407, 400; D21/699
See application file for complete search history.

(56) References Cited

U.S. PATENT DOCUMENTS 687,873 A * 12/1901 Daniels ..... F41J 7/04 273/390
1,258,931 A * 3/1918 Newcombe ..... A63B 67/06 273/402
1,598,865 A 9/1926 Limerick
1,666,336 A * 4/1928 Mallard ..... A63F 9/02 124/7
1,965,838 A 7/1934 Stanley
2,126,102 A 8/1938 Fowier
2,580,799 A * 1/1952 Lauterbach ..... A63B 63/00 473/476
3,134,594 A * 5/1964 Crowley ..... A63B 63/083 473/433
4,057,248 A 11/1977 Stoecker
4,295,648 A * 10/1981 Stromback ..... A63B 63/00 473/456
4,497,485 A 2/1985 Macosko
4,635,943 A * 1/1987 Lumpkin ..... A63B 67/06 473/588
4,872,674 A 10/1989 Deal
4,936,578 A * 6/1990 Hudson, Sr. ..... A63B 63/00 473/439
5,330,199 A * 7/1994 Vand ..... A63B 53/04 273/400
5,433,434 A 7/1995 Helmetsie
5,704,855 A 1/1998 Kellogg, Jr.
6,220,976 B1 * 4/2001 Kaiser ..... A63B 63/008 473/439

(Continued)

*Primary Examiner* — Mitra Aryanpour
(74) *Attorney, Agent, or Firm* — Luedeka Neely Group, PC

(57) ABSTRACT

A basketball shooting aide locatable between a player shooting a basketball and a basketball goal to help the player to recognize an opportune moment to take a shot, to develop quickness in taking the shot at the moment, and to develop shooting accuracy. The aide includes a frame supported by a support, the frame having a gap located at an upper portion of the frame and oriented so that during use of the aide when the basketball is shot through the frame toward the goal the basketball will pass through the slot on its path to the goal.

4 Claims, 2 Drawing Sheets

(56) References Cited

U.S. PATENT DOCUMENTS

| | | | | |
|---|---|---|---|---|
| 6,620,065 | B2 * | 9/2003 | Clabough | A63B 63/00 473/439 |
| 6,939,241 | B1 | 9/2005 | Chang | |
| 7,134,977 | B2 | 11/2006 | Campbell et al. | |
| 7,401,785 | B1 * | 7/2008 | Waite | A63B 63/00 473/476 |
| 7,534,178 | B2 * | 5/2009 | Nicely | A63B 69/0002 473/421 |
| 7,648,421 | B2 | 1/2010 | Yoon | |
| 7,931,547 | B2 | 4/2011 | Bishop | |
| D730,460 | S * | 5/2015 | Zampese | D21/699 |
| 9,095,755 | B1 * | 8/2015 | Hill | A63B 69/0071 473/447 |
| 9,739,576 | B1 | 8/2017 | Venigalla | |
| 2002/0091021 | A1 | 7/2002 | Clabough | |
| 2004/0104534 | A1 | 6/2004 | Trapani | |
| 2005/0012266 | A1 | 1/2005 | Kelley et al. | |
| 2008/0171619 | A1 | 7/2008 | Nicely | |
| 2008/0248901 | A1 | 10/2008 | Mosier et al. | |
| 2012/0065003 | A1 | 3/2012 | Trout | |
| 2015/0321062 | A1 | 11/2015 | Tyndall | |
| 2018/0147467 | A1 * | 5/2018 | Constantin | A63B 69/0071 473/447 |

* cited by examiner

BASKETBALL SHOOTING AIDE

FIELD

This disclosure relates to the field of basketball shooting aides. More particularly, the disclosure relates to a basketball aide configured to improve scoring by a basketball player.

BACKGROUND

Improvement is desired in aides for training a basketball player to hit shots. In particular, when a basketball player is being guarded, the player must be able to take advantage of a moment when it is most opportune to take a shot and avoid the guarding attempts. This requires visual recognition of the moment and then quickness in taking the shot at that moment, in addition in accurate shot placement.

Also, when shooting free throws a player is not guarded. However, it has been observed to help with shooting efficiency for a player to develop a rhythm in taking the shot.

The present disclosure advantageously provides a basketball shooting aide configured to train a basketball player in recognizing an opportune moment to take a shot and to develop quickness in taking the shot. The aide also helps the player to develop accurate shooting habits in both guarded and unguarded situations.

SUMMARY

The above and other needs are met by basketball shooting aides locatable between a player shooting a basketball and a basketball goal to help the player to recognize an opportune moment to take a shot, to develop quickness in taking the shot at the moment, and to develop shooting accuracy.

In one aspect, the aide includes a frame supported by a support, the frame having a gap located at an upper portion of the frame and oriented so that during use of the aide when the basketball is shot through the frame toward the goal the basketball will pass through the slot on its path to the goal.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1:
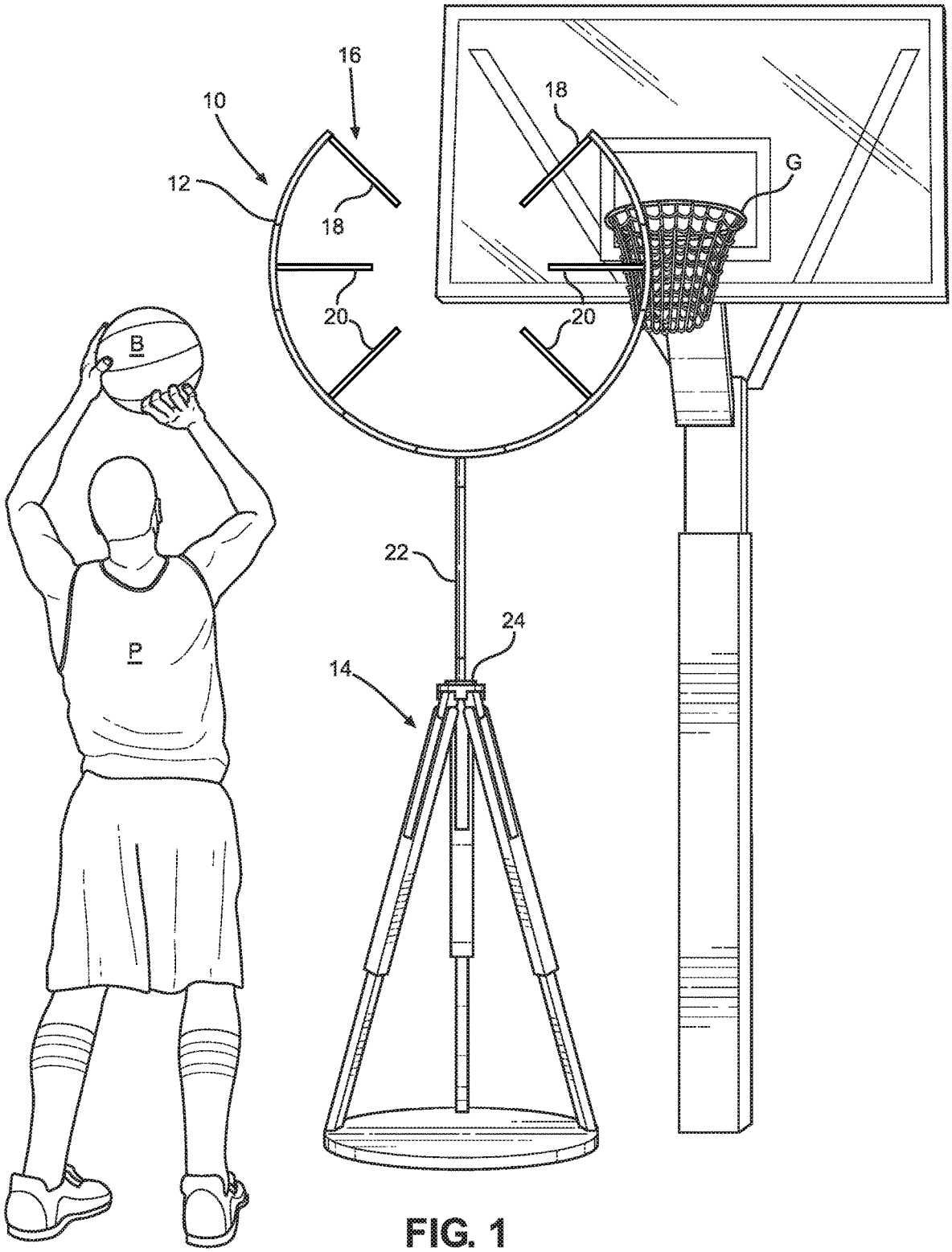
FIG. 1 shows a basketball shooting aide according to the disclosure.

With reference to the drawings, there is shown a basketball shooting aide 10 locatable between a player P shooting a basketball B and a basketball goal G and configured to help the player P to recognize an opportune moment to take a shot with the basketball B, to develop quickness in taking the shot at the moment, and to develop shooting accuracy in both guarded and unguarded situations. The aide 10 is desirably positioned about halfway between the player P and the goal G.

The aide 10 includes a frame 12 supported by a support 14. The frame 12 is preferably circular or hoop-shaped, but may be of other geometry such as a square or other polygon. For use with a regulation basketball, the frame 12 preferably has a diameter of about 44 inches. Regardless of the geometry, the frame 12 is configured to define a slot gap 16 configured to be located at an upper portion of the frame 12 and oriented for the basketball B to pass through the slot 16 on its path to the goal G. For basketball, the gap 16 is preferably about 28 inches across.

Adjacent the slot gap 16 are angled rods 18 that extend from the opposite edges of the slot 16 toward a center of the frame 12 and visually accentuate the slot 16. Additional angled rods 20 also preferably extend inwardly from the frame 12 toward the center of the frame 12. The angled rods 18 and 20 cooperate to define a central circular open area as shown having a diameter of about 20 inches.

Figure 2:
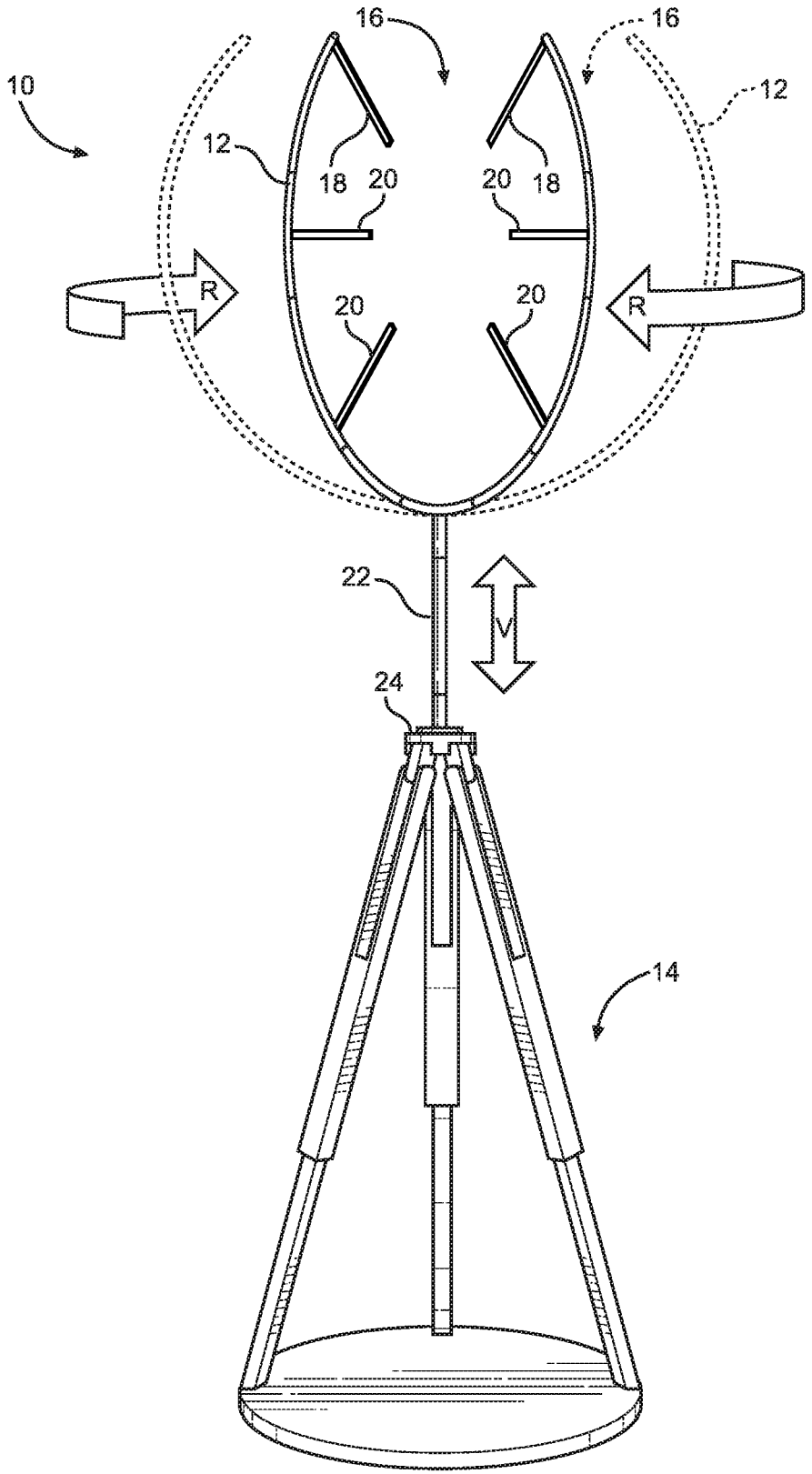
FIG. 2 shows a rotational feature of the shooting aide of FIG. 1.

A lower end of the frame 12 is adjustably connected to the support 14 as by a rod 22 adjustably positionable relative to a motorized rotatable mount 24 positioned on the support 14, such as telescopically. As shown in FIG. 2, this enables the frame 12 to be vertically adjustable as indicated by the arrow V and for the frame 12 to rotate relative to the support 14 as indicated by arrows R. The mount 24 may include an electric motor powered as by a battery. The rotational rate is preferably variable so as to enable the player P to train relative to different conditions. For example, to train for shooting a shot such as a jump shot corresponding to heavy defensive pressure from an opposing player, the player may choose to utilize a rapid rate of rotation. On the other hand, when working on developing free throw shooting, the play may choose a slower rate of rotation.

The vertical adjustment of the frame 12 is beneficial to cooperate with varying distances from the goal and varying heights of players. The rotation of the frame 12 serves to intermittently render the gap 16 in a position so as to be aligned with a direct path between the player P and the goal G. Thus, the player P is promoted to shot only if and when a shot presents itself corresponding to the gap 16 being aligned with a direct path to the goal G. This aspect enables training of the player in recognizing an opportune moment to take a shot and to develop quickness in taking the shot. This also develops timing of the shot motion to help develop accurate shooting habits in both guarded and unguarded situations.

The gap 16 is visible to the human eye but it is also believed to serve as a coordinate and contour marker inside the player's brain. It is believed that the brain is firing impulses, considered to be exercise, in the gap location which allows the brain to subconsciously convert depth or distance perception into an absolute location neurologically. This neurological activity is believed to alter the outcome of a locomotor related activity or task being performed by altering the amount of cognitive input necessary to perform the task. It is also believed that the brain is more likely to repeat an intended action consistently if an internal reward is triggered by a successful shot while under a constraint. Training in an environment where a constraints led approach can be manipulated via natural neuro-electrical impulses through visual prompts is paramount to building the internal confidence associated with becoming a successful shooter.

It has been observed that the aide 10 is useful to train a basketball player and that the training results in improved shooting performance. While the aide as described herein has been observed to be useful for the described training, why the aide works is not known. However, without being bound by theory, it is believed that the aide 10 engages the brain of the player during training sessions by enhancing the neurological space which defines the path of the basketball to the goal. These engineered spaces assist the player in judging path and distance of any particular shot. To achieve the desired consistency and effectiveness the players brain must be exercised using a constraint led approach. This requires placing the shooters brain under a constraint, which the aide 10 provides. Placing the brain's electrical system under a constraint requires manufacturing a constraint from electrical impulses from within the players own brain. Greater shot command and consistency is achieved by enhancing the brain's ability to exercise within its own electrical parameters. Further, when the frame 12 rotates during use of the aide 10 by the player P, it is believed that a greater number of brain neurons are being stimulated within the noted constraint system. The constantly changing electrical environment is believed to afford a greater probability of strengthening the visual/motor communication network.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

The invention claimed is:

1. A basketball shooting aide locatable between a player shooting a basketball and a basketball goal to help the player to recognize an opportune moment to take a shot, to develop quickness in taking the shot at the moment, and to develop shooting accuracy, the aide comprising a frame supported by a support and a motor operatively associated with the frame to rotate the frame relative to the support, the frame having a gap located at an upper portion of the frame and oriented so that during use of the aide when the basketball is shot through the frame toward the goal the basketball will pass through the slot on a direct path to the goal.

2. The aide of claim 1, further comprising a pair of angled rods extending from opposite edges of the slot toward a center of the frame.

3. The aide of claim 1, further comprising angled rods extending inwardly from the frame toward a center of the frame and oriented relative to one another to define a central circular open area.

4. The aide of claim 1, wherein the frame is vertically adjustably relative to the support.

* * * * *